US009827477B2

(12) United States Patent
Stacey

(10) Patent No.: US 9,827,477 B2
(45) Date of Patent: Nov. 28, 2017

(54) PILATES AQUATICS DEVICE

(71) Applicant: Jennifer M. Stacey, Moraga, CA (US)

(72) Inventor: Jennifer M. Stacey, Moraga, CA (US)

( * ) Notice: Subject to any disclaimer, the term of this patent is extended or adjusted under 35 U.S.C. 154(b) by 0 days.

(21) Appl. No.: 14/265,764

(22) Filed: Apr. 30, 2014

(65) Prior Publication Data

US 2015/0314158 A1 Nov. 5, 2015

(51) Int. Cl.

| | |
|---|---|
| ***A63B 21/008*** | (2006.01) |
| ***A63B 26/00*** | (2006.01) |
| ***A63B 22/00*** | (2006.01) |
| ***A63B 71/00*** | (2006.01) |
| ***A63B 31/00*** | (2006.01) |
| ***A63B 31/10*** | (2006.01) |
| ***A63B 69/12*** | (2006.01) |
| ***A63B 21/068*** | (2006.01) |
| ***A63B 21/00*** | (2006.01) |

(Continued)

(52) U.S. Cl.

CPC ..... *A63B 69/12* (2013.01); *A63B 21/0084* (2013.01); *A63B 21/068* (2013.01); *A63B 21/4034* (2015.10); *A63B 21/4035* (2015.10); *A63B 21/023* (2013.01); *A63B 21/0606* (2013.01); *A63B 22/0087* (2013.01); *A63B 31/10* (2013.01); *A63B 2208/0204* (2013.01); *A63B 2208/0214* (2013.01); *A63B 2208/0233* (2013.01); *A63B 2208/0238* (2013.01); *A63B 2208/0252* (2013.01); *A63B 2208/0285* (2013.01); *A63B 2208/03* (2013.01); *A63B 2209/10* (2013.01); *A63B 2210/50* (2013.01)

(58) Field of Classification Search

CPC ..... A63B 31/02; A63B 31/10; A63B 31/04; A63B 31/12; A63B 31/18; A63B 31/00; A63B 21/0084; A63B 69/12; A63B 69/154; A63B 69/14; A63B 31/08; A63B 31/11; A63B 35/00; A63B 35/06; A63B 31/0002; B63C 9/00; B63C 9/08

USPC ..... 441/55–58; 482/51, 55

See application file for complete search history.

(56) References Cited

U.S. PATENT DOCUMENTS 662,069 A * 11/1900 Hoglund ..... 441/58
675,695 A * 6/1901 Whitcomb ..... 441/58

(Continued)

FOREIGN PATENT DOCUMENTS

DE 20 2005 001 125 U1 10/2005
DE 10 2007 017 947 A1 10/2008

(Continued)

OTHER PUBLICATIONS www.macrointico.com/category.jhtm?cid=43 Jun. 2, 2013 @Macro International 2013.*

(Continued)

*Primary Examiner* — Nyca T Nguyen
(74) *Attorney, Agent, or Firm* — Thomas M. Freiburger

(57) ABSTRACT

A Pilates Aquatics Device (PAD) including a board, the board being generally rectangular, planar, buoyant, and having top and bottom surfaces, first and second sides that are generally parallel to one another with a longitudinal axis midway there between, first and second ends generally perpendicular to the longitudinal axis, and a strap defining three loops on the top surface of the board, the loops aligned along the axis, the loops defining openings perpendicular to the axis for insertion of a user's hands or feet to control the PAD.

7 Claims, 13 Drawing Sheets

(51) Int. Cl.
*A63B 21/02* (2006.01)
*A63B 21/06* (2006.01)

(56) References Cited

U.S. PATENT DOCUMENTS 1,455,826 A * 5/1923 Yorgnesen ..... 441/58
1,535,896 A * 4/1925 Bociek ..... 441/58
1,546,670 A * 7/1925 O'Sullivan ..... 441/58
2,536,390 A 1/1951 Pobochenko
2,709,266 A 5/1955 Munn
3,417,415 A 12/1968 Kozak
3,945,068 A * 3/1976 Carbonero ..... A63B 69/14 441/56
4,362,518 A * 12/1982 Boissiere ..... A63B 69/14 441/60
4,621,382 A * 11/1986 Burriss ..... B63C 9/08 441/129
4,662,852 A * 5/1987 Schneider et al. ..... 441/132
4,754,499 A * 7/1988 Pirie ..... 2/20
5,643,154 A * 7/1997 Awbrey ..... A63B 21/0004 482/111
6,142,843 A 11/2000 Haase
9,038,871 B2 * 5/2015 Atwood et al. ..... 224/218
2009/0193560 A1 * 8/2009 Provezano et al. ..... 2/21

FOREIGN PATENT DOCUMENTS

DE 20 2009 003 470 U1 5/2009
WO 2007 019 635 A1 2/2007

OTHER PUBLICATIONS

Balance Board with Straps Datasheet (online), Therapeutics 2013 https://web.archive.org/web/20130128114132/http://www.theraquatics.com/6006.html.
International Search Report (ISR) from the USPTO as the International Searching Authority (ISA) of corresponding Application No. PCT/US201515/28608, dated Aug. 19, 2015.
Written Opinion (WO) from the USPTO as the International Searching Authority (ISA) of corresponding PCT Application No. PCT/US201515/28608, dated Aug. 19, 2015.

* cited by examiner

PILATES AQUATICS DEVICE

BACKGROUND

History of Pilates

Pilates is a system of movement, exercise, health and lifestyle that was originally developed by Joseph and Clara Pilates in the first half of the 20$^{th}$ century. Joseph Hubertus Pilates originally named his method "Contrology" which integrates the disciplines of Eastern philosophies with the rigors of western athleticism to develop and balance the body and mind for perfect health.

Joseph Pilates invented many apparatus to assist the clients in accomplishing their movements with greater ease. He invented The Cadillac, The Universal Reformer, The Wunda Chair, The High Chair, The Ped-a-Pul, The Ladder Barrel, The Spine Corrector, The Toe Corrector, the Foot Corrector, The Magic Circle and many other devices.

Pilates is a widely accepted and popular form of movement to enhance health, performance, flexibility, strength, posture, gait and alignment. These movements or skills comprise what is known as the Pilates Repertoire. Joseph Pilates believed the key to longevity was a free and unencumbered spine. It is practiced worldwide by a variety of people, from the severely injured and pregnant, to elite athletes, dancers and actors. Doctors often recommend the practice of Pilates to recover from and prevent injuries, back pain and other problems.

There are many books written about the Pilates Method which include the following: *Return to Life* by Joseph Pilates, *Movement Perspectives™ and Teaching the Universal Reformer Repertoire* by Jennifer Stacey, M S., *Pilates* by Rael Isacowitz, *Pilates for Dummies* by Ellie Herman, *The Pilates Body* by Brooke Siler, A M, *Pilates* by Jillian Hessel, and *Every Body Beautiful* by Ron Fletcher. There are many DVDs on Pilates.

History of Exercise in Water

Many people swim and do water aerobics and strength training in pools around the world. People have used numerous forms of flotation devices to aid in their workouts. The kick board is commonly used for training swimmers' legs. It comes in many shapes and sizes. They are held by a swimmer, in front of the swimmer, while the swimmer is prone (or supine) and flutter-kicking the legs, while doing laps in the pool. There are flotation devices like the pull buoy that can be placed between the legs to allow the swimmer to use only the arms when doing laps. Water aerobics classes often use swim noodles, aquatics dumbbells, and tubing. Children use swim noodles and water wings to play safely in the pool. Swimmers use hand paddles and fins to propel themselves through the water more quickly.

History of Pilates Exercise in Water:

Over the last decade, a few people in America, England and Brazil have taught some of the Pilates exercises in the pool using the wall of the pool, swim noodles and single kick boards. Some people claim to teach Pilates in the pool, when in fact the movements they teach are often not Pilates skills.

What is needed to teach Pilates skills is a new form of apparatus that can be used in the water.

SUMMARY

Exemplary embodiments disclose mechanisms and devices for the classic Pilates Repertoire to be performed in a swimming pool or any serviceable body of water. A person who is a student of Pilates, or a more advanced practitioner of the skill, will be referred to hereinafter, interchangeably, as a "person," "user," or "student."

The structural features of an exemplary Pilates Aquatics Device (hereinafter interchangeable with PAD) includes its ergonomic shaping, its relative buoyancy, the degree of resistance to passage through water, and the dimensions and shaping that create the potential for the user to beneficially exercise muscle groups while controlling the PAD.

The dimensions, material, placement of openings and straps all combine to provide a novel experience for the user and more specifically the potential for using the exemplary device to practice the Pilates Repertoire without resort to the expensive and space-consuming apparatus formerly needed for such practice. The user can perform the Pilates Repertoire in water with the aid of the Pilates Aquatics Device.

In the past, dedicated Pilates apparatus has been needed to practice Pilates exercises (also referred to as the Pilates Repertoire). Exemplary embodiments are directed to a device that facilitates these exercises in an aquatic environment.

In accordance with exemplary embodiments, the PAD comprises a board that is generally rectangular, planar, buoyant, and has top and bottom surfaces, first and second ends, and sides that are generally parallel to one another with a longitudinal axis midway there-between. The first and second ends are generally perpendicular to the longitudinal axis. A strap defining three loops is provided on the top surface of the board, the loops are aligned along the axis and define openings perpendicular to the longitudinal axis for insertion of a user's hands or feet to control the PAD.

DETAILED DESCRIPTION

Figure 1:
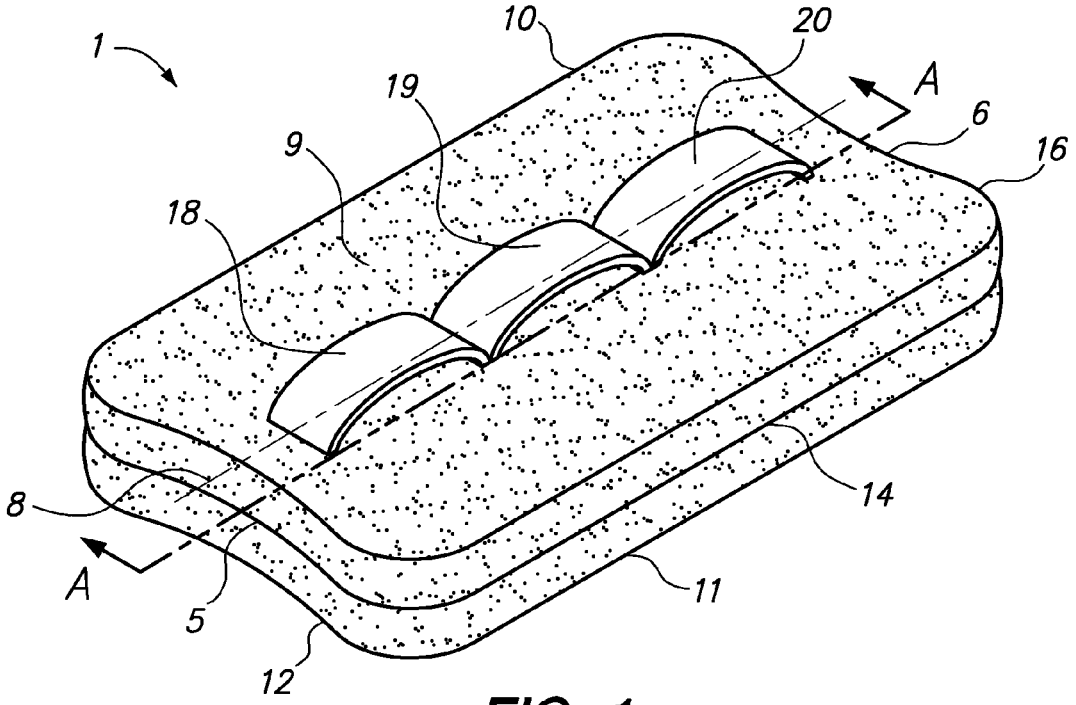
FIG. 1 is a perspective view of the PAD.

With continued reference to the drawings, FIG. 1 discloses a Pilates Aquatics Device (PAD) including a rectangular-shaped board shown generally at 1 and straps 18, 19 and 20. The board is generally rectangular shaped and is buoyant and floats in water and can be made of various materials, for example high-density closed-cell foam or other known closed-cell polymeric materials. In some embodiments, the board can be constructed from other buoyant natural or man-made materials. The board may be one piece or layered, as shown in FIG. 1. In some embodiments, the board can also be hollow.

Both ends 12 and 16 of the board are symmetrical and preferably concave portions as seen at 5 and 6 to allow the board to ergonomically fit under the armpit or in the hand. The sides 10 and 14 of the board are generally straight from one end to the other with rounded corners that lead to the ends 12 and 16. The ends 12 and 16 are ergonomic for the hand and tuck nicely under the armpit for Pilates Repertoire skills such as The One Hundred.

Every edge is preferably rounded to make it comfortable for the hands and feet, and allows for easy ergonomic gripping of the board and thus offers more control of the board. The board is rigid so it does not bend in the water but the surface preferably has a slight softness to it, so it is comfortable to touch and will not put pressure on the user's joints. Surfaces 9 and 11 allow the hand or foot to slide under the straps, but are not slippery, so the feet and hands can stay naturally in the straps when using the board.

The PAD is large enough but not so large that it is unwieldy, and is shaped to accommodate various sizes of hands and feet. Its shape is designed to accommodate feet of various sizes to fit on the board when both legs are parallel, turned out and when using one leg. Its shape allows the user to perform skills close to a step or wall of a swimming pool without hitting it, but it is large enough to provide the right amount of buoyancy in and resistance through the water.

Thus it can be seen that the PAD described above comprises a board 1 that is generally rectangular, planar, and buoyant. The board has top surface 9 and bottom surface 11, and first and second sides 10 and 14 that are generally parallel to each other with a longitudinal axis 8 midway therebetween. The board has first and second ends 12 and 16 which are generally perpendicular to the longitudinal axis 8.

Three straps 18, 19 and 20 defining corresponding loops are located on the top surface 9 of the PAD where the loops are located along the axis 8 and the loops define openings perpendicular to the longitudinal axis 8 for insertion of a user's hands or feet to control the PAD.

In some embodiments, multiple PADs may be strapped together. In other embodiments, a modified PAD can include one or more boards with or without straps that may be sandwiched together for additional strength and/or buoyancy. The additional board(s) may be of equal or different thicknesses. See FIGS. 1A and 1B.

Figure 1A:
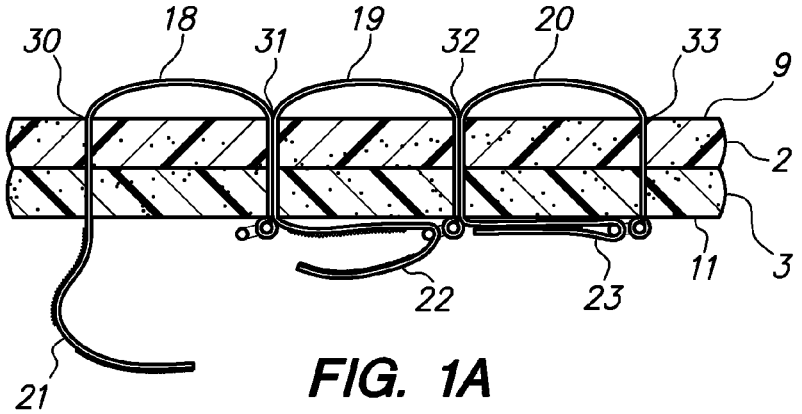
FIG. 1A is a partial perspective cross-sectional view of the PAD, taken along section line A-A in FIG. 1.

FIG. 1A is a cross-section showing three straps 18, 19 and 20 extending through openings 30, 31, 32 and 33 through two board layers 2 and 3. The straps may be adjustably secured below board layer 3 by conventional means such as hook-and-loop strips and buckles 21, 22 and 23 or other types of fasteners. In some embodiments, one long strap can be woven through the openings 30, 31, 32 and 33. In additional embodiments, the individual straps can be adjustable in length to change the size of the loops defined between the straps and the top surface 9 to accommodate various size hands or feet. In other embodiments, a single layer can be used.

Figure 1B:
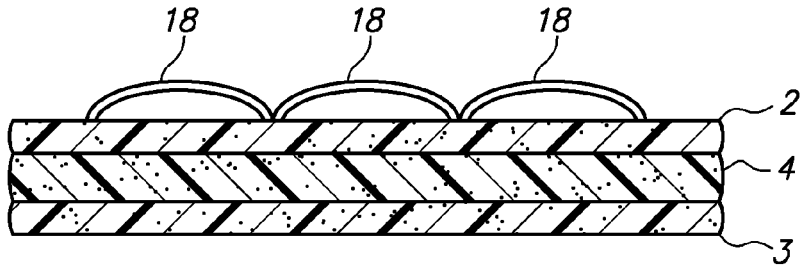
FIG. 1B is an alternate embodiment of the PAD, taken along section line A-A as shown in FIG. 1.
Figure 2A:
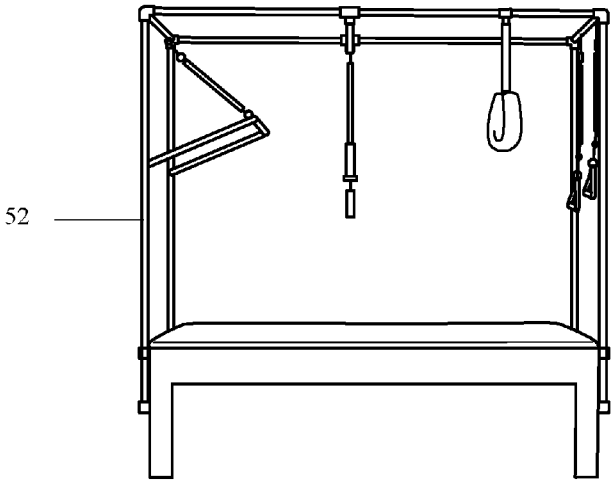
FIG. 2A illustrates the Cadillac.
Figure 2B:
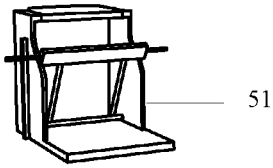
FIG. 2B illustrates the Pilates Chair.
Figure 2C:
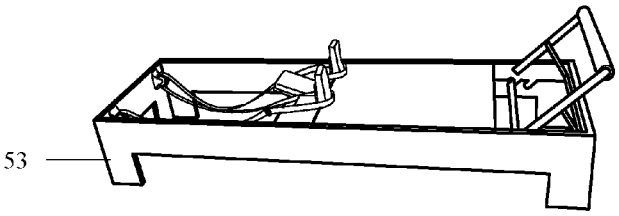
FIG. 2C illustrates the Universal Reformer (Reformer)
Figure 2D:
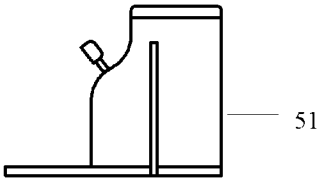
FIG. 2D is a side view of the Pilates Chair shown in FIG. 2B.
Figure 2E:
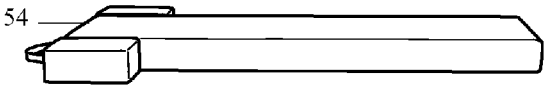
FIG. 2E illustrates the Pilates Mat with moon boxes.
Figure 2F:
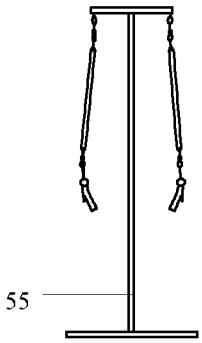
FIG. 2F illustrates the Ped-a-pol.

FIG. 1B shows an alternative embodiment of board 1 comprising multiple layers 2, 3 and 4. As shown, layers 2, 3 and 4 may be of unequal thickness or density to accommodate the size, weight and strength or the user, and the specific Pilates skill performed. Some Pilates skills require more resistance or buoyancy; some require less.

The above-described combinations of boards may be supplied as a kit which can include a secondary optional device that attaches several boards together such as an elastic band that encircles the boards, or an extra set of straps that attach the boards together using the slots or existing straps, or a clip.

There are three adjustable straps 18, 19, 20, for example Velcro or the like, or other fastening devices, attached to the top 9 and/or bottom 11 of the board that are spaced, for example, 4¾" to 5" apart and are threaded through the board defining three loops on the top surface of the board, the loops aligned along the axis, the loops defining openings perpendicular to the axis for insertion of a user's hands or feet to control the PAD. "Loops" and "openings" are used interchangeably herein.

The straps may extend from the top to the bottom of the board(s) and Velcro or the like or other fastening devices at the bottom of the board 11. The slots 30, 31, 32, 33 for the straps are, for example, ½" to ⅝" wide and approximately 2½" long. The straps run longitudinally down the midline of the board. The straps are inset approximately 2" in from the end of the board.

The left side of the middle strap 19 threads through the same slot 31 as the left strap 18, and the right side of the middle strap threads through the same slot 32 as the right strap 20. The straps are between 16" to 24" long and are adjustable.

The functions of the straps are: (1) to provide means to hold multiple boards together, (2) to attach the user's hand(s) or foot (feet) to the board to perform Pilates and other skills on or in the water at all angles and planes, (3) to allow the user to push or pull the board through the water at all angles and planes, and (4) to prevent the board from flying out from under the user's hands or feet while moving.

Other means for holding multiple boards together, such as elastic bands, straps with buckles, straps with fasteners, etc., may be utilized in exemplary embodiments.

A piece, for example 2"×5", of Neoprene or the like to provide comfort for the hand or foot that is contacting the strap may be glued or otherwise affixed to the inside of each strap. The straps are 2" wide in order to hold different size feet and hands comfortably on the board. Straps, if too thin, are not comfortable and the performer does not have as much control of the PAD; if too wide, they would not accommodate smaller hands and feet.

The straps 18, 19, and 20 are adjustable depending on the size of the foot or hand, or depending upon the number of boards that are attached. The ends of the straps 18, 19 and 20 are adjustable with fastening devices such as buckles, Velcro tabs or the like on the bottom of the board 11. The space of apex of the loop from the board is approximately 1¼" to 1½" high to allow a foot or hand in, but it can be adjusted.

The spacing of the straps is important for several reasons: (1) To accommodate feet of various sizes to fit on the board when both legs are parallel, turned out and when using one leg. (2) To accommodate all sizes of hands to be inserted into the straps. (3) Alignment of the hands and arms in a proper biomechanical line with the shoulders, and body; and the legs and feet in proper biomechanical relationship with the hips. (4) The middle strap 19 is placed directly in the middle of the board to obtain a correct biomechanical relationship of the hand and arm with the shoulders, and body; and the legs and foot in proper biomechanical relationship with the hips. (5) Therefore the positions of all three straps 18, 19 and 20 protect the joints and promote biomechanical efficiency and proper technique. (6) The middle strap 19 is placed in the middle of the board for ideal control and stability of the board moving through water. The outer straps 18 and 20 also promote control and stability of the board.

A person can insert a foot in the outer straps 18 and 20 when performing a skill with both legs. A person can insert a hand in the outer straps 18 and 20 when using both arms during a skill. When using a single arm or leg, the person inserts his/her hand or foot in the center strap 19. The straps are placed so the arms are in the correct biomechanical relationship with the shoulders, and the legs and feet are in correct biomechanical relationship with the hips.

Thus the placement of the straps promotes proper ergonomics and biomechanics when a skill is performed. It also aligns the body and limbs in a correct line with counterbalancing forces when pushing the board down and up vertically in the water.

The person performing a Pilates Repertoire can use one, two, three or four boards depending on the height and weight, and skill level of the performer, and the movement that is being performed. Some skills require more buoyancy and/or resistance through the water, some require less. Larger or more dense people will tend to need more buoyancy than smaller or less dense people.

The Pilates Aquatics Device (PAD) allows a person to perform the Pilates Repertoire and other systems of movement (inspired by skills based on yoga, Moshe Feldenkrais, Gyrotonic® and dance) in the water in various ways that were never offered before. A person can use the PAD to replicate the movements that are performed on the Pilates apparatus such as the Pilates Wunda Chair, High Chair, The Universal Reformer (often referred to as "The Reformer"), The Cadillac, The Ped-a-Pul, the Spine Corrector and other Pilates apparatus. The above apparatus, with the exception of the Spine Corrector, are illustrated in FIG. 2A-2F.

The resistance of the PAD traveling through the water, and the buoyancy of the PAD in the water, is similar to the motion and action of the following: The springs of the Pilates Apparatus; the pedal of the Chairs; the carriage (barre and straps) of the Reformer; the barre on the Cadillac. They all require the student to control the motion through functional movement and use of center (hereinafter also referred to as "core").

A person using the PAD can perform the Pilates Repertoire in many ways with either the hand(s) or foot (feet) attached to the board: (1) Sitting on the edge of the pool. (2) Lying on the edge of the pool. (3) Kneeling on the edge of the pool. (4) In the pool and hands on the edge or wall of the pool. (5) Standing in the pool with the hand(s) or feet (foot) on the board. (6) Sitting on the stair of the pool. (7) Standing on the stairs of the pool. (8) Performing a front or back plank with the hands or feet on the board. (9) Lying on the side with the head on the board and the hands on the step. (10) Lying prone on the board with the board crossways performing the Pilates Mat and Reformer Box work. (11) Lying supine in the water with the boards tucked under the armpits and the hands on the end of the board, so each arm is on the board, and (12) many more options. There are over 200 skills that can be performed using the Pilates Aquatics Device.

Practitioners of various skill level and health, age, size and shape can use the PAD. It can be used to help the user recover from injury and pain, or from back, neck or posture problems. The work increases the user's balance, center/core flexibility, strength, coordination, control, and breathing. The work can enhance alignment, posture and gait, sports and dance performance. It can be gentle, but it can also challenge the most advanced athletes, acrobats, and fitness professionals.

Moving in the water is supportive of joints and acts as a smooth force of resistance. The water provides a greater proprioceptive challenge for some of the skills because of its motion. Some of the advanced skills that require moving or supporting the body weight are easier to do in the water. Therefore a student or practitioner with certain physical restrictions can learn these advanced skills in a safer environment without risk of injury. This also enables a student or practitioner of Pilates to try the advanced repertoire earlier than would otherwise be possible.

Using the Pilates Aquatics Device can be advantageous since it is small, portable and is an affordable option for performing the Pilates Apparatus work. Pilates apparatus cost between $900 and $6000 each. The Universal Reformer costs between $3,000 and $5,500. The Cadillac costs between $3,500 and $5,600. The Chairs cost between $900 and $1900. The Ped-a-pul costs between $500 and $1,000. The Pilates Mat costs between $1,000 and $1500. The Spine Corrector costs between $300 and $600.

Pilates studios or Fitness Centers that offer classes must own numerous apparatus (more than $80,000 worth for example) which requires a lot of money and a large space (which can be costly to rent). The creation of the PAD also opens up the opportunity to conduct or practice Pilates exercise classes in a brand-new venue: that is, swimming pools and other suitable bodies of water.

The Pilates Aquatics Device can be used at Fitness, Recreation, or Physical Therapy facilities, at Country Clubs and other venues that do not own Pilates apparatus, do not own enough apparatus to offer comprehensive classes, or do not have the space for numerous apparatus, but do have a swimming pool.

A person can use a PAD while travelling or on retreat. A teacher can teach a student the entire Pilates Repertoire during private, semi-private or class sessions without having access to the apparatus. Practitioners will also enjoy the opportunity to practice Pilates outside rather than always indoors. Joseph Hubertus Pilates loved the outdoors and often worked with his springs on the outside of his barn at his countryside home.

So it follows the philosophy of Mr. Pilates' appreciation of health and being outdoors. It provides more environments and opportunities for practitioners of the Pilates Repertoire. This is advantageous, since Pilates is a known method to enhance health and fitness.

The Pilates Aquatics Device is unique and has a multitude of improve-ments and advancements over the kick board.

No kick board has previously been made that is designed with three straps (for feet or hands) placed on it. No kick board has been made with three straps threaded down the longitudinal midline. The Pilates Aquatics Device is unique, and an improvement on the function of the kick board.

No device has been specifically designed for performing the Classic Pilates Apparatus Repertoire in the water.

Hundreds of Pilates skills can be performed on the Pilates Aquatics Device that replicate the skills performed on many of the Pilates apparatus. The straps 18, 19 and 20 keep the hands and feet to the board allowing the user to move the board in all directions, like the motion of the Pilates apparatus, and also prevent the board from flying out uncontrollably when pushing down on it in the water.

The PAD in the water is extremely effective at causing the user to (1) automatically find center ("core"), (2) perform the Pilates' skill with proper mechanics, and (3) feel the internal muscles work immediately. The water supports joints, provides smooth resistance and is safe and non-impact. The Pilates Repertoire performed on the Pilates Aquatics Device can provide a greater proprioceptive challenge in the water than when the Repertoire is done with the Pilates apparatus, because of the motion of the water, demanding that the user work optimally with gravity and the principles of physics.

The water often places the user in the proper position. Much of the Pilates Chair Repertoire for the Pilates Aquatics Device requires the body, leg or arm to be perpendicular in order to successfully master the skill.

What follows is a more detailed description of how the Pilates Repertoire performed on the prior art devices shown in FIGS. 2A through 2F can be replicated on the PAD with emphasis on the structural features of the PAD that make this replication possible.

The above-described structural features of the PAD make possible the Pilates Repertoire in the water. Reference to the drawings will illustrate that this is possible and emphasize the structural features of the board that make it possible. It can be seen that the PAD has been carefully devised in its structural features to achieve such things as the potential to use the PAD at the sidewall of a pool, to tuck under the armpit of the user, etc.

Figure 3A:
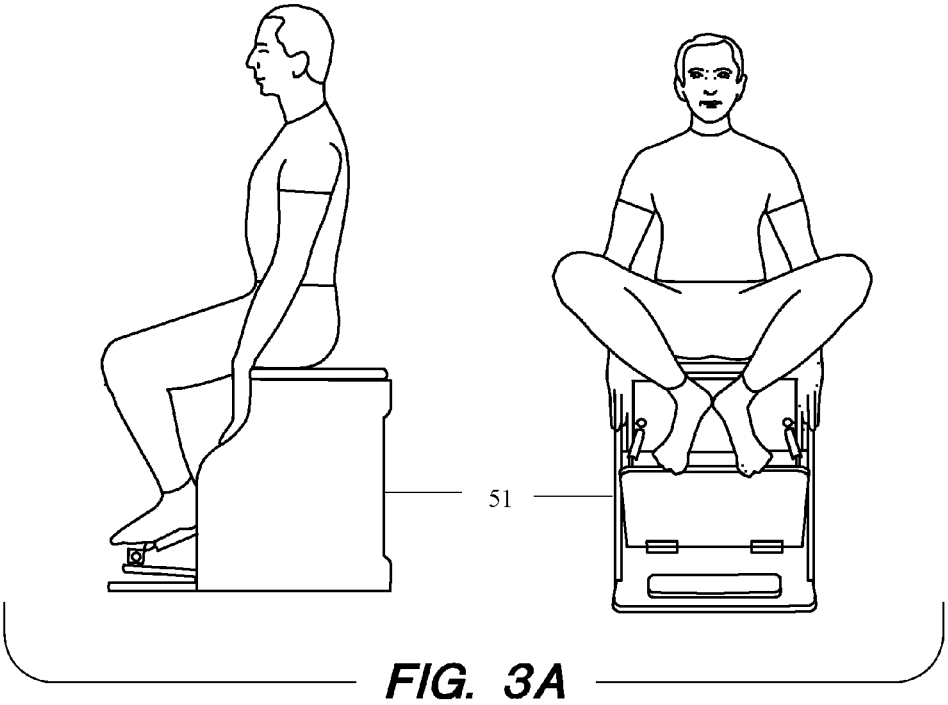
FIG. 3A illustrates performance of footwork on the Wunda Chair.

FIG. 3A illustrates classic Pilates Footwork routine performed on the Pilates Wunda Chair 51. The Wunda Chair is one of the Pilates Chairs. Sit on the top of the chair with the feet on the pedal. The Footwork can be performed with the heels, arches or toes on the pedal, with the feet in parallel or turned out with the hips in external rotation and the feet in the "V" position. Inhale, push down the pedal, hold it down three counts, exhale allow the pedal to slowly come up. Press the hands against the front of the Chair 51 to engage the back of the shoulder.

Figure 3B:
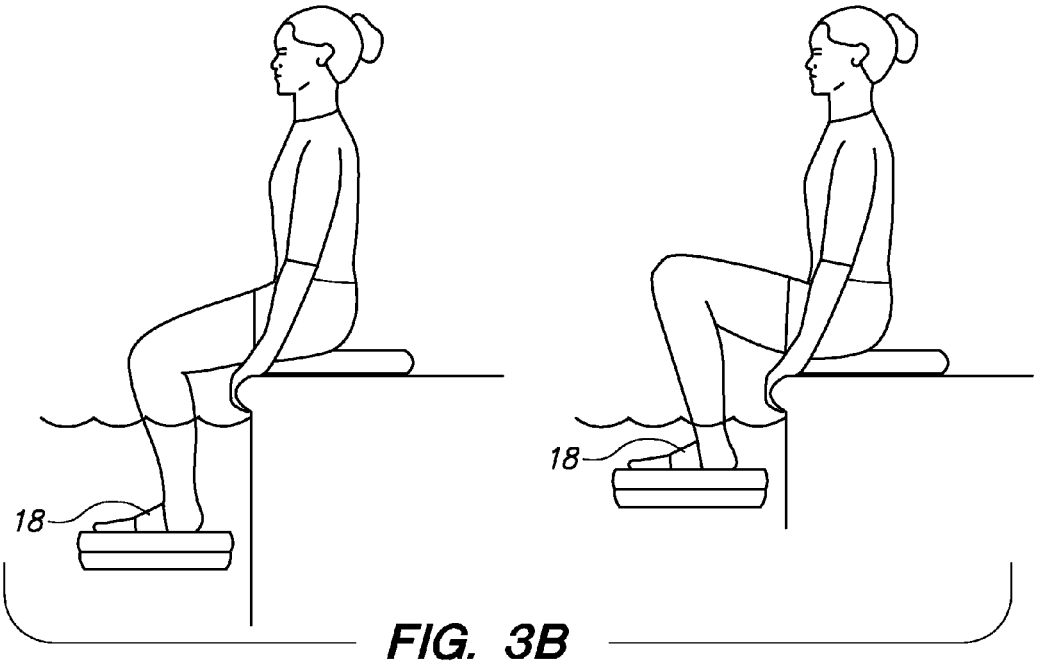
FIG. 3B illustrates performance of footwork using the PAD.

FIG. 3B illustrates classic Pilates Footwork routine performed using the Pilates Aquatics Device. The Chair Footwork is performed using the Pilates Aquatics Device by sitting on the edge of the swimming pool with the feet placed in the outer straps 18, 20. Perform this skill the same way, with the same goals, with the feet in parallel and turned out in the "V."

The straps are situated on the board so the legs and feet are in correct alignment with the hips both in the parallel and "V" turned out position, and the straps are located just far enough from each other and in the right position on the board to allow the heels to press together on the "V" position. The straps are placed in the midline of the PAD so the feet are in the middle (longitudinal) of the PAD so the PAD can successfully be pushed down in a balanced manner through the water, with the PAD remaining relatively horizontal as it travels through the water.

The buoyancy and surface area of the PAD provides the same resistance as the springs on the chair as the PAD is pushed down, and the user must control the board coming up in the same way as a user must control the pedal of the Chair 51 coming up. The length of the PAD is as wide as the Chair 51 pedal. The length of the PAD provides a surface area large enough to have the correct buoyancy (and resistance) but is not too large that it becomes difficult to manage.

It is wide enough and long enough for all foot sizes to fit comfortably on the PAD and in the straps 18 and 20 with the feet both in parallel and in the "V" position. Push down the board, hold it down three counts, and then allow the PAD slowly to come up. Press the hands against the wall of the pool to engage the back of the shoulder.

Figure 4A:
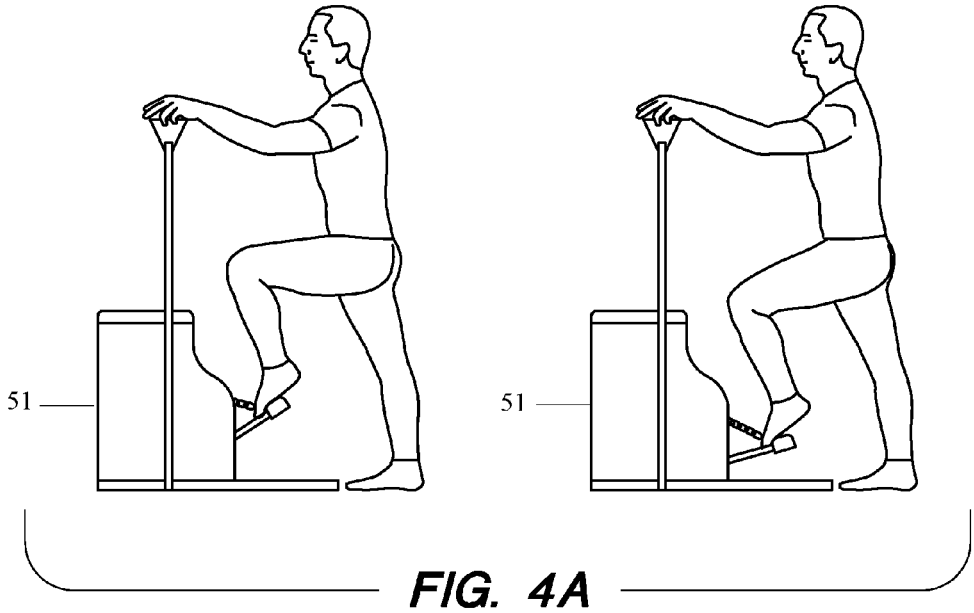
FIG. 4A illustrates performance of the Leg Pull on The Wunda Chair.

FIG. 4A illustrates the classic Pilates One Leg Pull on the Chair 51. Stand in front of the chair, facing the chair. Place the hands on the handles, legs together. Place the left foot on the pedal and bring the pedal down to the floor. Inhale, swing the left leg up to bring the pedal up. Exhale, swing the pedal down, keeping the leg bent. This can be performed with the hands on the hips.

Figure 4B:
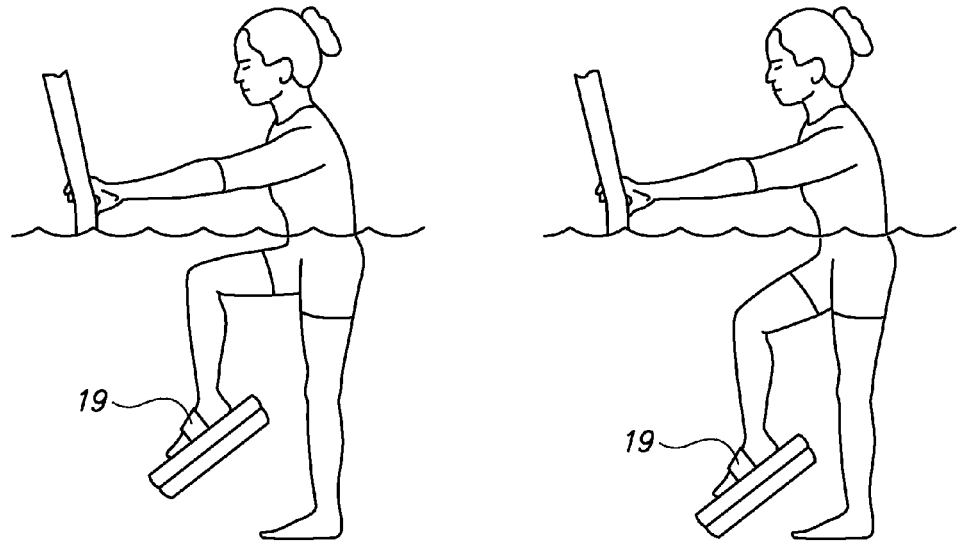
FIG. 4B illustrates performance of the Leg Pull using the PAD.

FIG. 4B illustrates the One Leg Pull on The Pilates Aquatics Device: Stand in the water on a step or on the bottom of the swimming pool holding onto the railing. It can also be performed with the hands on the hips. The left foot is in the middle strap 19 of The Pilates Aquatics Device and the leg is bent in front of the user. The PAD is wide enough, and the strap long enough to allow the foot to be centered comfortably in the strap and on the board. The strap secures the foot to the board so it does not fly out when performing this skill. This skill requires the adjustment of the strap to secure the foot to the board snuggly, so it does not slide on the surface of the board. The board and the strap are non-slippery so the foot remains in the strap.

The neoprene lining on the strap is soft around the foot and both the neoprene and substance of the board keeps the foot in the strap to allow the foot to travel through the water in a way similar as the 51 Chair pedal. The foam is hard enough to be stable in the water without folding. The dimensions of the board provide the buoyancy similar to the resistance provided by the 51 Chair's springs. Exhale, swing the leg and the board down from the hip keeping the leg bent. Inhale, swing the left leg up to bring the board up with control.

Figure 5A:
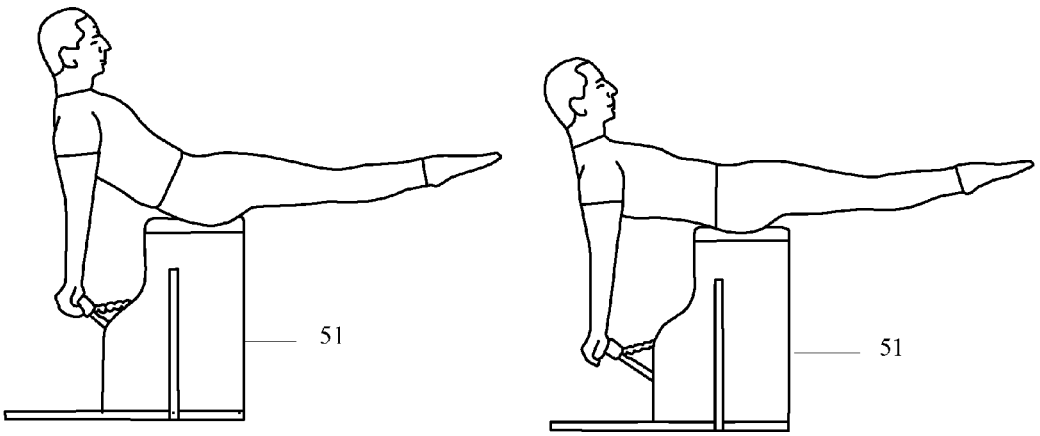
FIG. 5A illustrates the Reverse Swan performed on The Wunda Chair.

FIG. 5A illustrates The Reverse Swan or Torso Press: Sit on the top of the 51 Chair facing the back with the front edge of the 51 Chair one hand's width away. Place your hands on the pedal with the fingers facing forwards. Inhale, push the pedal down and lower your body three inches. Exhale, bring the pedal up, sliding your body toward the ceiling.

Figure 5B:
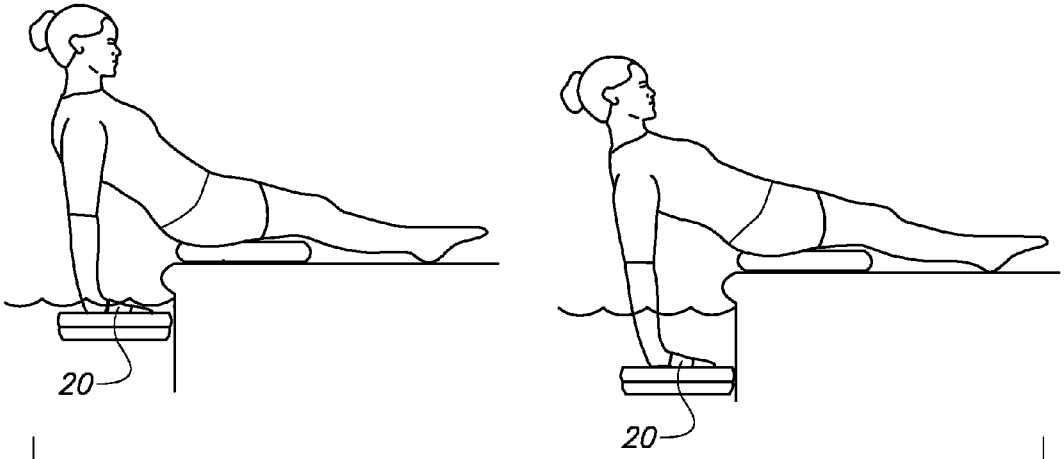
FIG. 5B illustrates the Reverse Swan performed using the PAD.

FIG. 5B illustrates the Reverse Swan or Torso Press Sit on the PAD. Sit on the area near the edge of the pool facing away from the pool with the seat one hand's width away from the edge of pool. The Pilates Aquatics Device™ is in the water next to the wall. Place the hands in the outer straps 18 and 20 of the Pilates Aquatics Device with the fingers facing forwards.

The straps 18 and 20 are the correct distance apart so the arms are in the proper alignment directly below the shoulders. Strap 18 and 20 are also placed equidistant from each end 12 and 16 so that an even force is effectively distributed on the PAD to control the PAD in the water. The straps hold the hands comfortably to the PAD.

The straps are placed on the longitudinal midline of the PAD so it is stable when the hands are attached to it and in the Reverse Swan it allows the PAD to travel vertically through the water in a balanced way, replicating the motion of the 51 Chair pedal. The width of the PAD is such that it is not too wide, and does not hit up against the wall while using it. The length of the PAD is as wide as the 51 Chair pedal. The straight edges 10 and 14 lie parallel with the straight wall, and thus diminishes the chance of hitting the wall. Push the PAD down about three inches, lowering the body. Then bring the board up.

Figure 6A:
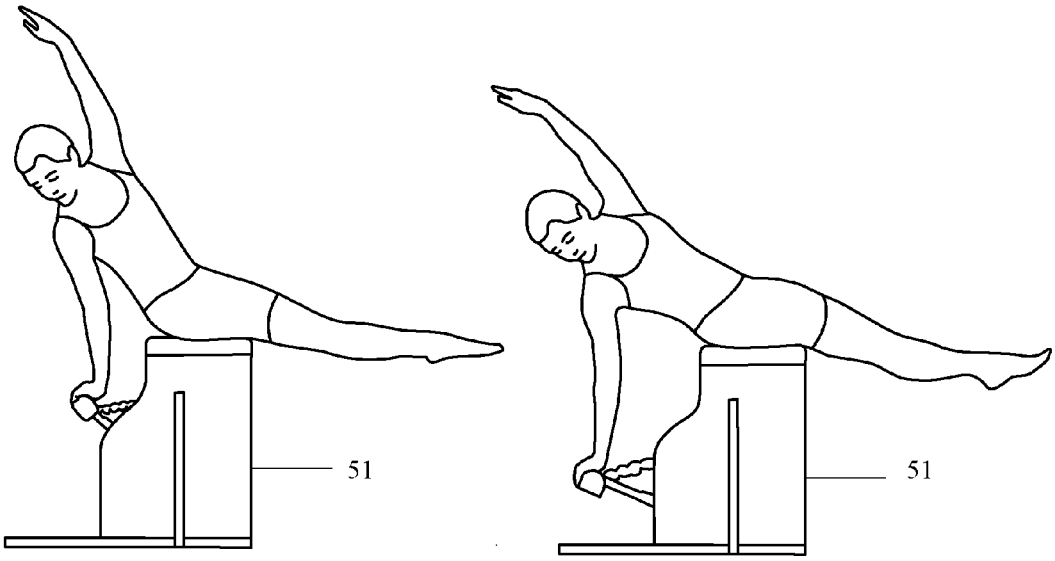
FIG. 6A illustrates the Twist performed on The Wunda chair.

FIG. 6A illustrates the classic Pilates Sit Twist on the Chair 51. Sit on top of the Chair 51, with the seat one hand's width from the front, facing back, in the same position as the Reverse Swan. Place the left hand on the pedal. Look at the left hand the entire time. The right arm is reaching to the wall and is by the ear. Inhale, push the pedal down, exhale, come up (bringing the pedal up) while rotating towards the left.

Figure 6B:
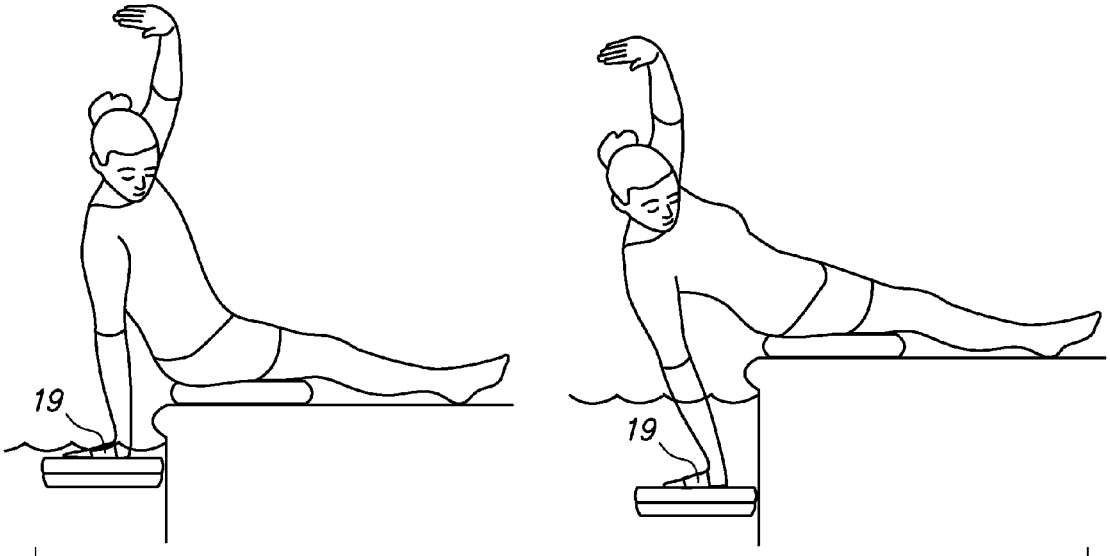
FIG. 6B illustrates the Twist performed using the PAD.

FIG. 6B Illustrates the Sit Twist using The Pilates Aquatics Device. Sit on the area near the edge of the pool facing away from the pool in the same position as the Reverse Swan. The seat is one hand's width away from the edge of pool. The Pilates Aquatics Device is in the water next to the wall. Place the left hand in the middle strap of the Pilates Aquatics Device. The hand feels secure because the strap is wide enough (but not too wide), is adjustable and has a neoprene pad under it, and the surface of the board is slightly soft and not slippery.

The center strap 19 is in the center of the board so that the user's hand can be placed in the center of the board, thus enabling the user to push the PAD through the water with a centered force, allowing for successful control of the PAD. The width of the PAD is such that it is not too wide, and does not hit up against the wall while using it.

The straight edges of edge 10 and 14 lie parallel with the straight wall, and thus diminishes the chance of hitting the wall. The arm is straight, but not hyper-extended or rotated. Look at the left hand the entire time. The right arm is long and is by the ear. Inhale, push the Pilates Aquatics Device down, lower the body, exhale, come up (bringing the board up) while rotating towards the left.

Figure 7A:
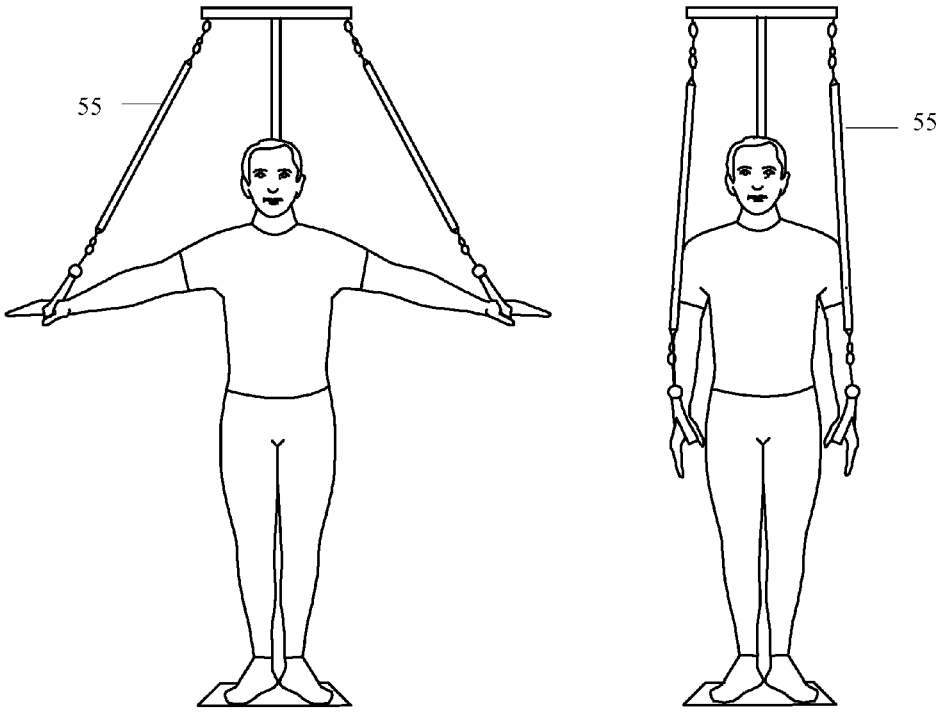
FIG. 7A illustrates the Sidearm Pull performed on The Ped-a-Pol.

FIG. 7A illustrates a classic Pilates exercise performed on The Ped-a-pul 55, the Side Arm Pulls. Stand on the base with the feet in Pilates "V," spine against the pole. Place the hands in the handles, fingers long. Bring the arms out to the side in the peripheral vision, hands just below shoulder height. Inhale, pull the springs down to the side. Exhale, bring the hands up.

Figure 7B:
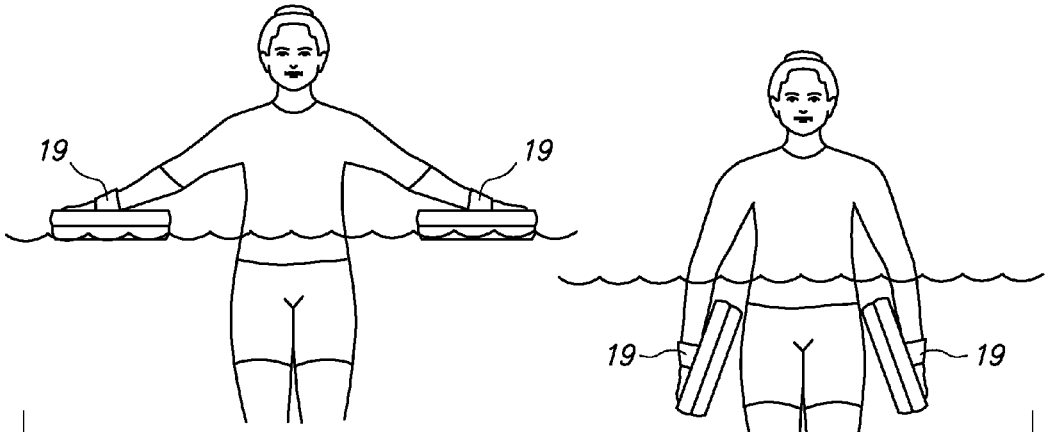
FIG. 7B illustrates the Sidearm Pull performed using the PAD.

FIG. 7B illustrates performing the Side Arm Pulls using two of the Pilates Aquatics Devices. Stand in the pool with the feet in Pilates "V." Place each hand into the middle strap 19 of each board. The buoyancy of the board replicates the resistance of the springs of the 55 Ped-a-pul. The neoprene lining on the strap is soft around the hand and both the neoprene and substance of the board keeps the hand in the strap to allow the PAD to travel through the water in a way similar as the 55 Ped-a-pul handles.

The middle strap 19 is placed in the middle of the board for efficient, even travel of the PAD through the water. The dimensions of the PAD are such that it is not too big and unwieldy for this skill. Bring the arms out to the side in the peripheral vision. Inhale, pull the boards down to the side. Exhale, bring the hands up with control.

Figure 8A:
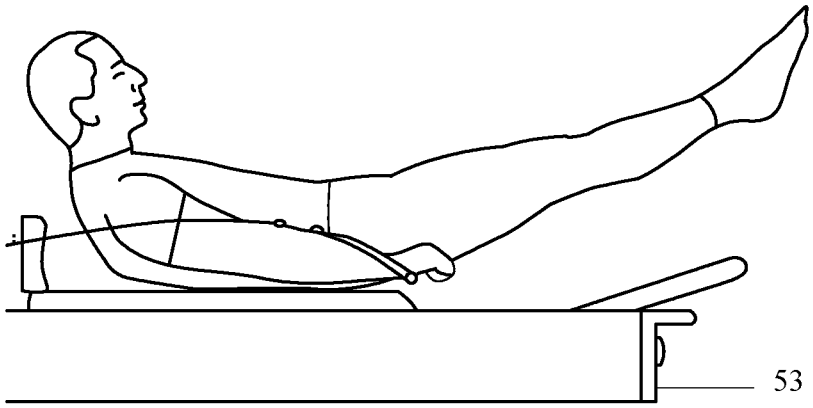
FIG. 8A illustrates the One Hundred performed on The Reformer.

FIG. 8A illustrates the classic One Hundred exercise on The Reformer 53. Look forward. Straps in the hands. Start pumping the straight arms from the back of the shoulder. Inhale at a continuous, controlled rate for five counts. Exhale at a continuous, controlled rate for five counts.

Figure 8B:
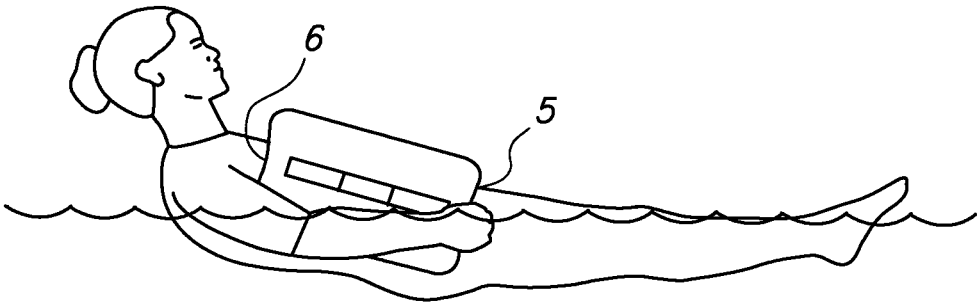
FIG. 8B illustrates the One Hundred performed using the PAD.

FIG. 8B illustrates the One Hundred as performed using the PAD. Two Pilates Aquatics Devices will be needed. Tuck one Pilates Aquatics Device under each armpit. The concave portion of end 16 fits nicely in the armpit. FIG. 8*b* intentionally does not show the board fully seated in the armpit to illustrate the curve of the end 12 of the board is a shape that conforms to the armpit. Wrap the hand around the opposite concave portion 5 of end 12 of the board, which conforms to the user's hand. The PAD is made of firm foam so it is rigid, but the soft outer surface is comfortable under the hand and feels like it conforms to the hand. The curved end 12 and the beveled edge also helps secure the PAD in the hand.

The arm runs along the longitudinal axis of the board (unless the user has short arms, in which case the board can be held the short way). Float the body and legs up and forwards into the One Hundred position. Legs long. Look forward. Start pumping the arms and PADs from the back of the shoulder. Inhale at a continuous, controlled rate for five counts. Exhale at a continuous, controlled rate for 5 counts.

When the PADs push down on the water they provide resistance to the arms, enabling control of the PADs coming up just as the straps on the 53 Reformer, or the Springs on the 52 Cadillac. The boards may be positioned sideways with the thumbs facing up and the palms facing in, or the user can try pulsing the boards down and up with the palms down and the bottom of the boards facing the water for a bigger challenge.

Figure 9A:
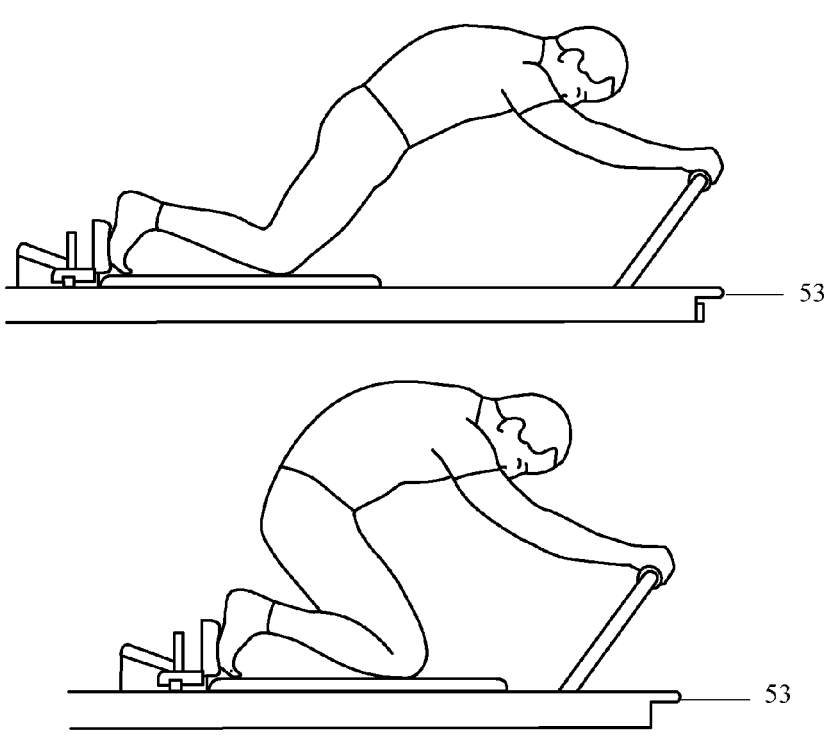
FIG. 9A illustrates the Knee Stretches performed on The Reformer.

FIG. 9A illustrates the classic Pilates Knee Stretches on The Reformer (53). Sit back onto the heels with the body rounded in a cat position. (1) Inhale, press the legs back. (2) Exhale, quickly bring the carriage forward to home. Keep the body still, while the thighs pendulum back and forward.

Figure 9B:
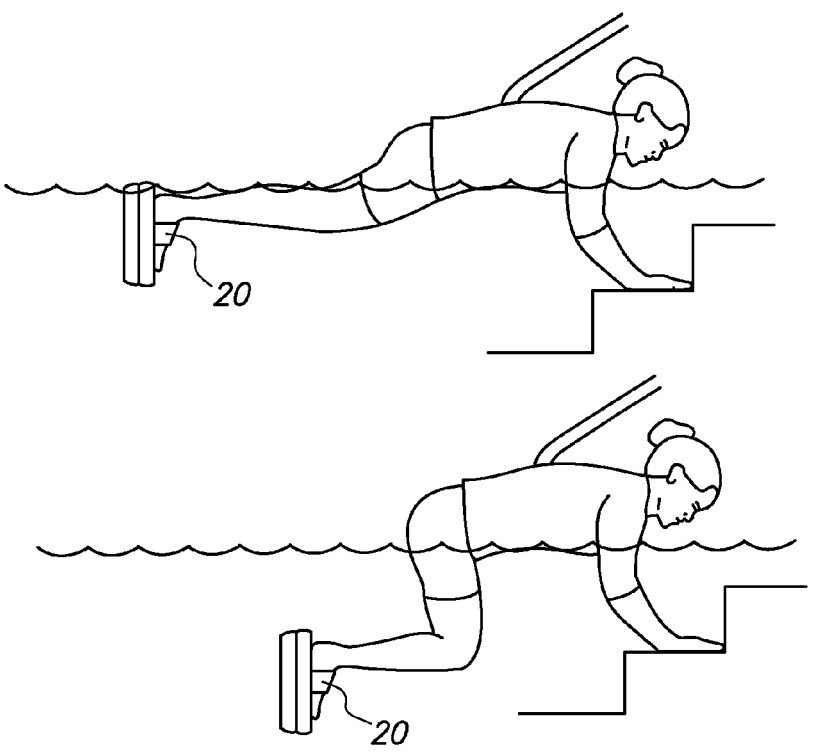
FIG. 9B illustrates the Knee Stretches performed using the PAD.

FIG. 9B illustrates Knee Stretches using the Pilates Aquatics Device. The feet are in the outer straps 18 and 20 of the Pilates Aquatics Device. The outer straps allow ergonomic placement of the legs in line with the hips, and are as wide as if the user were on The Reformer. The straps must be adjusted to keep the feet securely on the board. Put the hands on the top or second step of the pool, shoulders above the hands, the body in a plank position. Feet and PAD in the water behind the body. Exhale, bend the legs in, bring the PAD forward. The belly pulls the Pilates Aquatics Device in.

Inhale, stretch the legs back pushing the PAD back. Keep the body still, while the thighs pendulum back and forward. The straps 18 and 20 keep the feet attached to the board as it travels. The water and PAD provide resistance that makes the abdominals work. The oblong shape of the board allows it to travel without hitting the step or the bottom of the pool. The board is rigid so it does not bend as it travels through the water. The surface of the board and the straps is soft and non-slippery to keep the feet comfortable and secure.

Figure 10A:
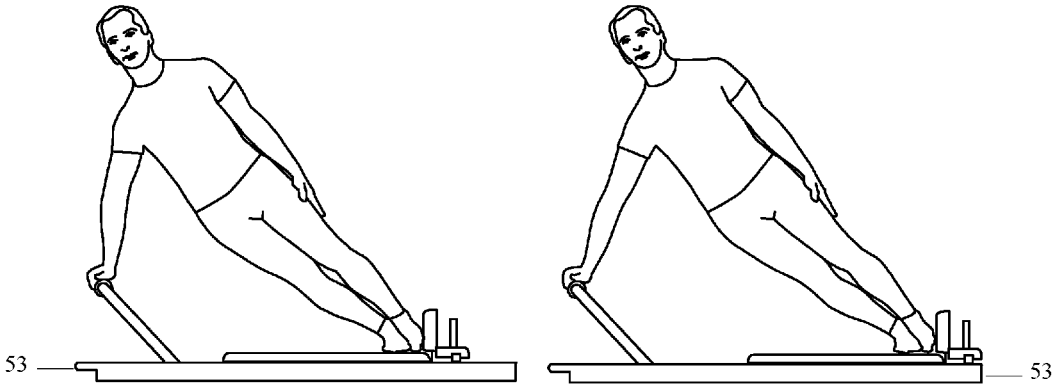
FIG. 10A illustrates the Star performed on The Reformer.

FIG. 10A illustrates the classic Pilates exercise called The Star on The Reformer. The body is in a long line like a fence. Inhale, push through the left arm to draw the carriage away. Exhale, pull the carriage in, reach through the crown of the head.

Figure 10B:
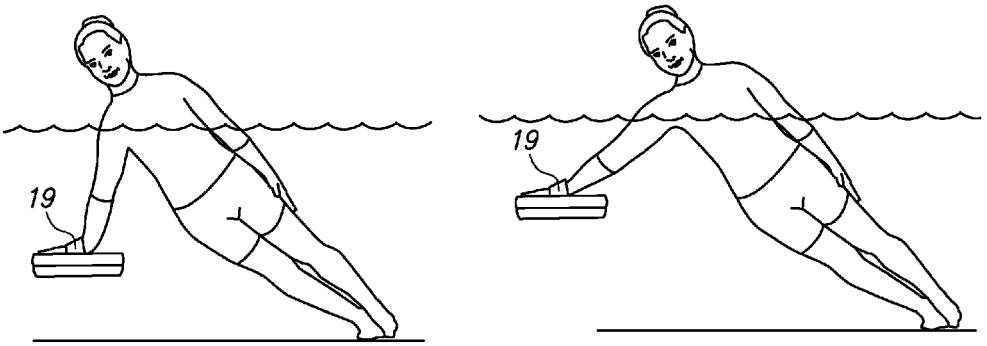
FIG. 10B illustrates the Star performed using the PAD.

FIG. 10B Illustrates The Star performed using the Pilates Aquatics Device. The feet are on the bottom of the pool and the left hand is in the middle strap 19 of the PAD. The strap keeps the hand attached to the board and the middle strap 19 allows the force placed on the board by the hand to be centered, and thus balanced. The body is in a long line like a fence. Inhale, push through the left arm to push the PAD away slightly. Exhale, pull the PAD in, reach through the crown of the head.

It is proprioceptively challenging since water has motion, so the user must use his or her center. However, the water is supportive, and the PAD buoyant enough that it is less stressful on the shoulder and neck in this version than performing it on the 53 Reformer or Mat 54. Therefore more people can try this skill, and perfect it before trying it on land.

Figure 11A:
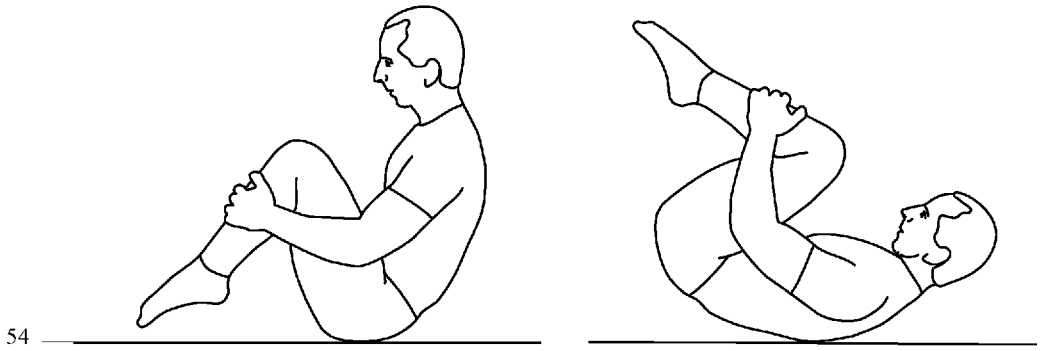
FIG. 11A illustrates the Rolling like a Ball performed on The Reformer.

FIG. 11A illustrates the classic Pilates Rolling-Like-A-Ball Repertoire on the Pilates Mat 54. Inhale, curl the tail and roll the lower body away from the legs. Exhale, roll back watching a point on the wall in front of you. Inhale, breathe into the back lungs to roll up. Keep watching that point on the wall.

Figure 11B:
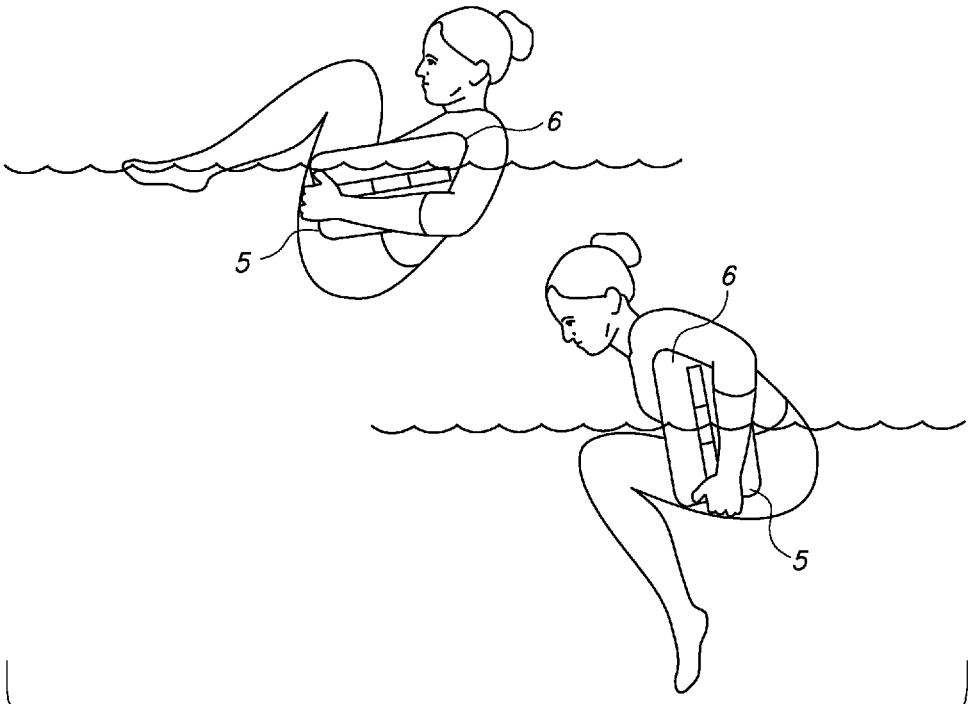
FIG. 11B illustrates the Rolling like a Ball performed using the PAD.
Figure 12A:
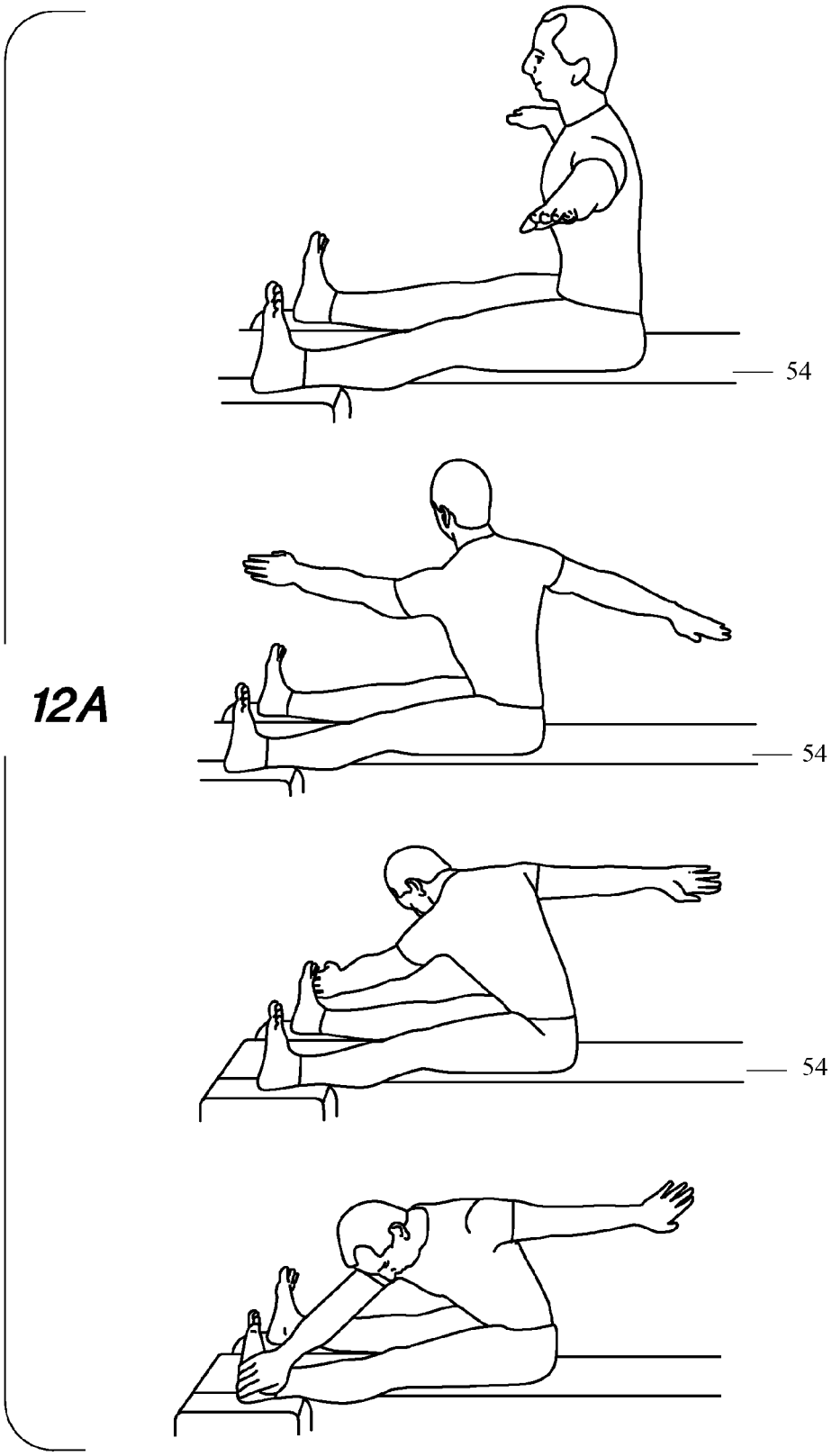
FIG. 12A illustrates the Saw performed on The Pilates Mat.
Figure 12B:
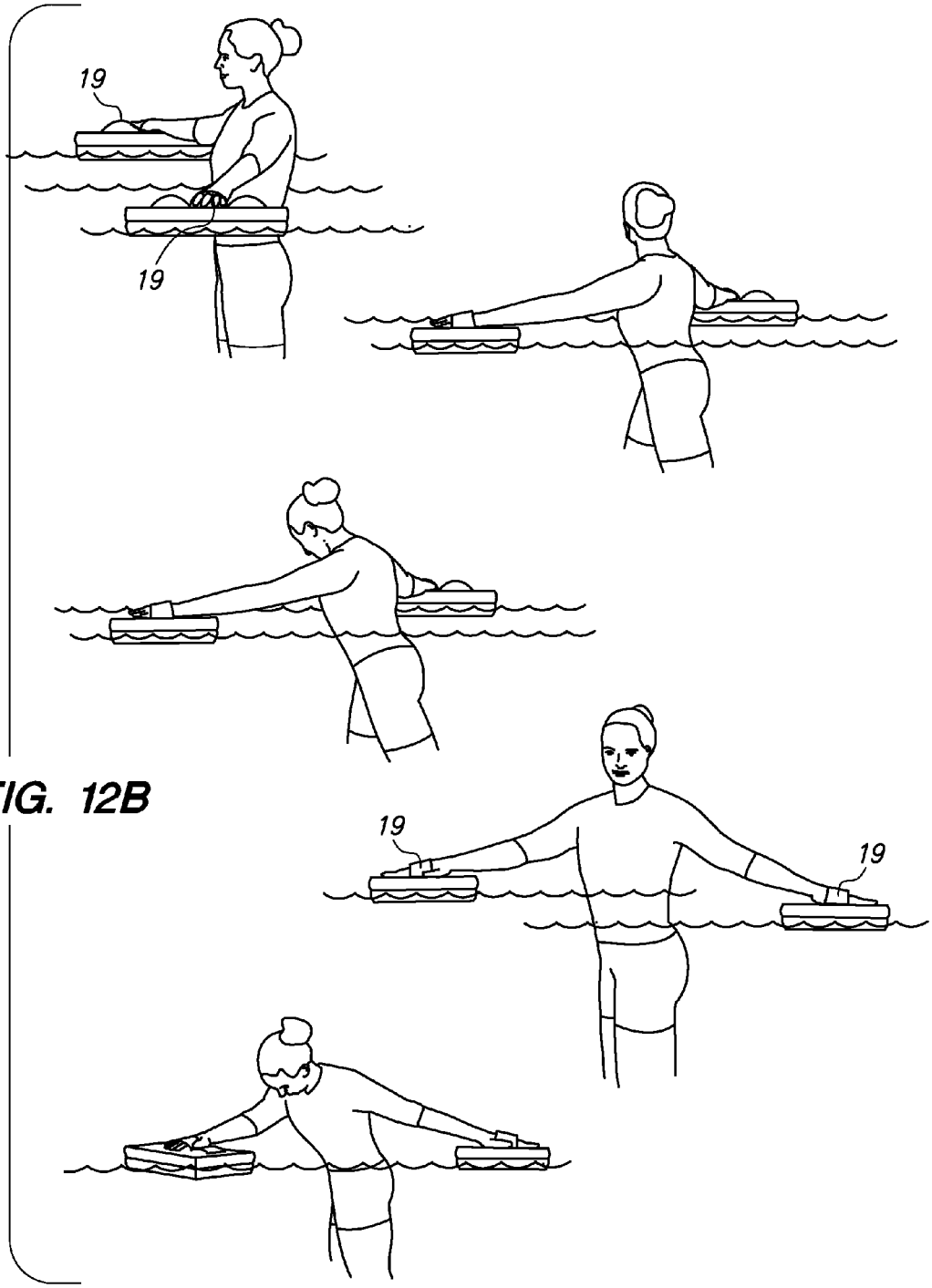
FIG. 12B illustrates the Saw performed using the PAD.

FIG. 11B Illustrates using the PAD to perform the Rolling-Like-A-Ball Repertoire. Two Pilates Aquatics Devices will be needed. Tuck one Pilates Aquatics Device under each armpit (with the concave end portion 6 fitting nicely under the armpit). Straighten the arm and wrap the hand around the opposite (concave) end portion 5 of the board. The concave shape, beveled edge and the texture of the board fits securely in the hand. The board is rigid so it will not bend, and will provide buoyancy and support for the body in the water. Its shape allows it to fit under the arm, while it is not too large or too small.

Float the body and legs up and forwards into the tucked position. Inhale, exhale roll like a ball forwards. Inhale, exhale, roll back watching a point in front of you. It is challenging remaining in the tucked position. People who have restrictions in the back will be able to perform this easier in the water than on the Pilates Mat 54.

The disclosure set forth above may encompass multiple distinct exemplary embodiments each having independent utility. Although each of these embodi-ments has been disclosed in a particular form, the specific embodiments thereof as disclosed and illustrated herein are not to be considered in a limiting sense, because numerous variations are possible.

The subject matter of the disclosure includes all novel and non-obvious combinations and subcombinations of the various elements, features, functions, and/or properties disclosed herein.

The following claims particularly point out certain combinations and subcombinations regarded as novel and non-obvious. Devices embodied in other combinations and subcombinations of features, functions, elements, and/or properties may be claimed in this application, in applications claiming priority from this application, or in related applications. Such claims, whether directed to a different or alternate embodiments, and whether broader, narrower, equal, or different in scope in comparison to the original claims, also are regarded as included within the subject matter of the disclosure.

What is claimed is:

1. A Pilates Aquatics Device (PAD) comprising:

a board, the board being generally rectangular, planar, rigid and sufficiently buoyant for supporting the weight of a stationary user in water, and having top and bottom planar surfaces, first and second sides that are each linear and generally parallel to one another with a longitudinal axis midway there between, and first and second ends generally perpendicular to the longitudinal axis, and the board having slots perpendicular to the longitudinal axis through the top and bottom surfaces;

a strap extending through the slots defining three loops on the top surface of the board, the loops being longitudinally spaced and aligned along the longitudinal axis, the three loops including two outer loops in symmetrical positions and a middle loop, each loop being in direct contact with an adjacent loop and the middle loop being in the geometric center of the board, the loops defining openings perpendicular to the longitudinal axis configured and sized for insertion of a hand comprising fingers, thumb and palm, or a foot including toes, arch and heel of the user to control the PAD;

wherein each of the first and second ends includes a concave portion forming an inward curve, each concave portion being centered about the longitudinal axis, the concave portions defining contoured surfaces for securing and controlling the PAD between one hand and an armpit of the user, such that the board is configured to be comfortably and securely held with the palm of the hand on the board and the fingers around one end of the board, and the board having all rounded edges.

2. The PAD of claim 1 wherein the board includes a plurality of boards, and means to connect the boards together.

3. The PAD of claim 2 wherein the means to connect the boards together is the strap.

4. The PAD of claim 1 wherein the first and second ends are generally symmetrical in shape.

5. The PAD of claim 1 wherein the board is made from a polymeric closed cell foam.

6. The PAD of claim 1 wherein the strap is a plurality of straps.

7. A Pilates Aquatics Device (PAD) comprising:

a board, the board being generally rectangular, planar, rigid and sufficiently buoyant for supporting the weight of a stationary user in water, and having top and bottom planar surfaces, first and second sides that are each linear and generally parallel to one another with a longitudinal axis midway there between, and first and second ends generally perpendicular to the longitudinal axis, and the board having slots perpendicular to the longitudinal axis through the top and bottom surfaces, wherein the only openings extending through the board are said slots;

a strap extending through the slots defining three loops on the top surface of the board, the loops being longitudinally spaced and aligned along the longitudinal axis, the three loops including two outer loops in symmetrical positions and a middle loop, each loop being in direct contact with an adjacent loop and the middle loop being in the geometric center of the board, the loops defining openings perpendicular to the longitudinal axis configured and sized for insertion of a hand comprising fingers, thumb and palm, or a foot including toes, arch and heel of the user to control the PAD;

wherein each of the first and second ends includes a concave portion forming an inward curve, each concave portion being centered about the longitudinal axis, the concave portions defining contoured surfaces for securing and controlling the PAD between one hand and an armpit of the user, such that the board is configured to be comfortably and securely held with the palm of the hand of the board and the fingers around one end of the board, and the board having all rounded edges.

* * * * *